US005481059A

United States Patent [19]

Brock et al.

[11] Patent Number: 5,481,059

[45] Date of Patent: Jan. 2, 1996

[54] SETTLING AIDS FOR SOLIDS IN HYDROCARBONS

[75] Inventors: Gene F. Brock, Oxnard, Calif.; Mark S. Binford; Paul R. Hart, both of The Woodlands, Tex.

[73] Assignee: Betz Laboratories, Inc., Trevose, Pa.

[21] Appl. No.: 319,753

[22] Filed: Oct. 7, 1994

[51] Int. Cl.$^6$ ..... C07C 7/00; C10G 17/00

[52] U.S. Cl. ..... 585/866; 585/865; 208/177

[58] Field of Search ..... 585/865, 866; 208/177

[56] References Cited

U.S. PATENT DOCUMENTS 4,539,099 9/1985 Merchant et al. ..... 208/177

4,559,133 12/1985 Siegfried et al. ..... 208/177

4,600,500 7/1986 Dickakian ..... 208/177

4,692,237 9/1987 Hsu et al. ..... 208/177

*Primary Examiner*—Sharon Gibson

*Assistant Examiner*—Nhat D. Phan

*Attorney, Agent, or Firm*—Alexander D. Ricci; Philip H. Von Neida

[57] ABSTRACT

A method for accelerating the settling of finely divided solids in hydrocarbon fluids comprising adding to the hydrocarbon a sufficient settling amount of a polyacrylic acid adducted alkylphenol-formaldehyde resin alkoxylate compound. Preferably, the hydrocarbon is a fluid catalytic cracker slurry containing spent catalyst fines.

6 Claims, No Drawings

SETTLING AIDS FOR SOLIDS IN HYDROCARBONS

FIELD OF THE INVENTION

The present invention relates to methods for accelerating settling of solids in hydrocarbon fluids. The methods of the present invention are particularly efficacious at accelerating the settling of FCC catalyst fines in an oil slurry.

BACKGROUND OF THE INVENTION

Unrefined hydrocarbons such as crude oil, resids and bottom streams often contain finely divided solid matter which often must be removed prior to further use or processing. These solids can include solids of a soil-like nature, finely divided silicas, clays, silt and coke, and metal oxide and sulfide corrosion solids. These solids may include traces of metal particles such as lead, nickel, chromium and the like, and salts thereof.

For instance, fluid catalytic cracker (FCC) units use a fluidized bed of zeolite type aluminosilicate clay particles to crack heavy petroleum fractions into lighter fractions at elevated temperatures. The catalyst is eventually deactivated by poisoning or coking. These spent fines must be removed from the FCC on a continual basis so that slurry containing fresh catalyst can be added.

Some of this slurry oil containing the spent fines is then typically settled in tankage, though hydrocyclones are sometimes used to accelerate the separation process. Both native and synthetic components of the slurry oil have a dispersant effect which retards the settling of the fines.

The present inventor has discovered that certain chemical agents, when added to the slurry oil, have an anti-dispersant or coagulent effect which accelerates the settling process. This produces a cleaner decant oil (typically <0.05 wt % ash) in a shorter period of time and can then be sold as carbon black feedstock or residual fuel oil.

DETAILED DESCRIPTION OF THE INVENTION

The present invention relates to methods for accelerating the settling of finely divided solids in hydrocarbon fluids comprising adding to the hydrocarbon an adduct of polyacrylic acid and an alkylphenol-formaldehyde resin alkoxylate. More particularly, the present invention provides methods for accelerating the settling of spent fluid catalytic cracker (FCC) catalyst fines in an oil slurry.

The settling aids are adducts of low molecular weight (MW=1000 to 2000) polyacrylic acid and an alkylphenol-formaldehyde resin alkoxylate. Preferred adducts are nonylphenolic resin propoxyethoxylate adducts such as those available from Arjay as AB-455 and Witco as DRI-9037.

The polyacrylic acid adducted alkylphenol-formaldehyde resin alkoxylates prove effective in a variety of hydrocarbon fluids. These hydrocarbon fluids are generally unrefined hydrocarbons that are prone to containing finely divided solids. These hydrocarbon fluids include but are not limited to crude oils, resids, bottom streams, vacuum bottoms, heavy ends and the like.

Actual dosage ranges for the adducts depend upon the characteristics of the hydrocarbon to be treated. These characteristics can vary and include the type of hydrocarbon, the type and amount of finely divided solid present, and the presence of other impurities and surfactants in the hydrocarbon. Preferably, about 10 parts to about 1000 parts of the adduct is added per million parts of the hydrocarbon. Different hydrocarbons will surely have different optimum dosage ranges.

The adducts can be fed to the hydrocarbon to be treated neat or in a suitable solvent that is compatible with the treatment and the hydrocarbon. Examples of such solvents include but are not limited to linear or branched chain aliphatic and aromatic solvents such as naphtha, toluene, xylene and the like.

The adducts of the present invention can be used in conjunction with other hydrocarbon treatment chemicals particularly flocculants which can be inorganic or organic and include any material that enhances aggregation of finely dissolved solids to form a floc and enhance settling of solids and phase separation or transfer, and demulsifiers, which can be any material that accelerates the settling of water with which the solids can be associated.

The following examples are intended to show the efficacy of the present invention as an accelerator for settling finely divided solids in hydrocarbons and should not be construed as limiting the scope of the invention.

EXAMPLES

Catalyst Settling Aid Test

This test measures the fraction of FCC catalyst fines which settle to the bottom of a slurry sample compared to the amount which remains dispersed on top. This test simulates slurry settling in tankage between ambient temperature and 200° F.

Experimental

Collect 100 mL of FCCU slurry in 6 oz. bottles. Place bottles in a water bath and heat to process temperature. Remove each bottle from the bath and add the appropriate treatment to the desired bottles. Place the bottles in an insulated shaker and shake on high speed setting for 10 minutes. Return the bottles to the bath and allow to stand undisturbed for the predetermined settling period. This predetermined settling time for a blank is determined by analyzing several untreated bottles according to this test procedure at various time intervals centered on the tank's residence time (e.g., 5 hours, 1 day, 3 days, 7 days).

For most samples, the 50% method described below is used. For extremely fast settling samples, a short settling time and the 95% method described below is used. For very slow settling samples, a long settling time and the 20% or 10% variation of the 50% method is used.

50% method (or 20% or 10%)

Pipet off the top 50 mLs (top sample) with a syringe being careful not to disturb the sample or insert the needle below the 50 (or 80 or 90) mL line, and transfer to a clean bottle. The original bottle contains the bottom sample.

95% method

Pour off ~95 mLs into a clean bottle (top sample). The remaining ~5 mLs in the original bottle is the bottom sample.

Place filter pads in small petri dishes, dry uncovered at 220° F. for one hour, remove from oven and allow to cool in a desiccator. Weigh and record filter weight.

Place filter in a paraoloid filtration funnel and wet with xylene or toluene to ensure a good seal for vacuum filtration. Shake the oil sample vigorously and carefully pour it up to 50 mL at a time into a graduated centrifuge tube, then double the volume, up to 100 mL, with xylene or toluene.

Heat the centrifuge tube to 180° F in a water bath. Centrifuge for 15 minutes. Turn on the vacuum pump and pour a small amount of hot oil from the centrifuge tube into the filter funnel and allow it to filter. Rinse with xylene or toluene. Continue adding small amounts and rinsing until all the sample has been filtered. Then rinse centrifuge tube and funnel with more xylene or toluene until it is clean. Remove filter bowl and wash, under vacuum, the filter pad with xylene or toluene followed by petroleum ether or heptane. Dry filter pad in an oven at 220° F. for one hour. Allow to cool in a desiccator and reweigh.

Place the filters in glass petri dishes and ash in a muffle furnace at ~900° F. Weigh again to determine catalyst weights, being careful not to disturb loose ash on filters.

The % settled is calculated by the following methods:

| 50% Method | 20% Method | 95% Method |
|---|---|---|
| $\% \text{ settled} = \frac{\text{bottom} - \text{top (g)}}{\text{bottom} + \text{top (g)}}$ | $\% \text{ settled} = \frac{\text{bottom} - 4 \times \text{top (g)}}{\text{bottom} + \text{top (g)}}$ | $\% \text{ settled} = \frac{\text{bottom} - (5/95) \times \text{top (g)}}{\text{bottom} + \text{top (g)}}$ |

A settling period which yields about 40 to 50% settled should be chosen. Repeat the optimal procedure determined from the blanks after adding chemical treatments at the process dosage.

Testing was performed utilizing the compounds of the instant invention and commercially available nonylphenol-formaldehyde resin ethoxylates.

TABLE I

Southern refinery
FCC slurry settling study
20 hours settling time at 160° F.

| Treatment (ppm) | Wt. in top 10 mL after 20 hours (g) | Avg. Wt. (g) | Weight of sample (g) | Wt. % | Avg. Wt. % |
|---|---|---|---|---|---|
| Blank | 0.019 | 0.019 | 10.71 | 0.177 | 0.177 |
| Blank | 0.025 | 0.025 | 10.71 | 0.233 | 0.233 |
| Comp 1 (75) | 0.012 | — | 10.92 | 0.110 | — |
| Comp 1 (75) | 0.008 | 0.010 | 10.52 | 0.076 | 0.093 |
| Comp 1 (150) | 0.009 | — | 10.24 | 0.088 | — |
| Comp 1 (150) | 0.013 | 0.011 | broken | — | 0.088 |
| Comp 1 (225) | 0.008 | — | 11.01 | 0.073 | — |
| Comp 1 (225) | 0.011 | 0.010 | 10.97 | 0.100 | 0.086 |
| A (67) | 0.002 | — | 10.54 | 0.019 | — |
| A (67) | 0.003 | 0.003 | 10.93 | 0.027 | 0.023 |
| A (133) | 0.003 | — | 10.02 | 0.030 | — |
| A (133) | 0.004 | 0.004 | 10.65 | 0.038 | 0.034 |
| A (200) | 0.002 | — | 10.93 | 0.018 | — |
| A (200) | 0.002 | 0.002 | 10.95 | 0.018 | 0.018 |

Comp 1 is a commercially available nonylphenol-formaldehyde ethoxylate.

TABLE I-continued

Southern refinery
FCC slurry settling study
20 hours settling time at 160° F.

| Treatment (ppm) | Wt. in top 10 mL after 20 hours (g) | Avg. Wt. (g) | Weight of sample (g) | Wt. % | Avg. Wt. % |
|---|---|---|---|---|---|

Treatment A is a nonylphenol-formaldehyde resin alkoxylate polyacrylic acid adduct.

These results indicate that the polyacrylic acid adducted alkyl-phenol-formaldehyde resin alkoxylates of the present invention provide adequate settling in an FCC slurry. This settling was faster and more effective than the commercially available compounds as very little amounts of solids were found still present in the top 10 mL after 20 hours.

TABLE II

Southern refinery
Slurry settling study
24 hours settling time at 135° F.

| Treatment (ppm) | Top 10% (mg solids)[1] | % Reduction From Blank |
|---|---|---|
| A (27) | 0.0060 | −7.14 |
| A (27) | 0.0067 | −19.64 |
| A (67) | 0.0059 | −5.36 |
| A (67) | 0.0059 | −5.36 |
| A (134) | 0.0062 | −10.71 |
| A (134) | 0.0056 | 0.00 |
| Comp 1 (30) | 0.0053 | 5.36 |
| Comp 1 (30) | 0.0061 | −8.93 |
| Comp 1 (75) | 0.0059 | −5.36 |
| Comp 1 (75) | 0.0057 | −1.79 |
| Comp 1 (150) | 0.0053 | 5.36 |
| Comp 1 (150) | 0.0050 | 10.71 |
| Comp 2 (35) | 0.0061 | −8.93 |
| Comp 2 (35) | 0.0058 | −3.57 |
| Comp 2 (88) | 0.0057 | −1.79 |
| Comp 2 (88) | 0.0064 | −14.29 |
| Comp 2 (175) | 0.0040 | 28.57 |
| Comp 2 (175) | 0.0055 | 1.79 |

[1]in this test, the top 10% was thiefed and analyzed for solids

Treatment A is a nonylphenol–formaldehyde resin alkoxylate polyacrylic acid adduct Comp 1 is a commercially available nonylphenol–formaldehyde resin ethoxylate.

Comp 2 is a commercially available nonylphenol–formaldehyde resin ethoxylate.

These testing results indicate that the polyacrylate crosslinked alkylphenolic resin alkoxylates of the present invention are as effective as the commercially available compounds in this particular slurry.

TABLE III

Northeast refinery
Slurry settling study
50% filterable solids method

| Treatment (ppm) | Filterable Solids Data: Solids in top 50% (g) | Solids in bot 50% (g) | % Settled (B − T)/B + T) | % Solids in top 50% | Ash Data: Ash in top 50% (g) | Wt. % Ash in top 50% |
|---|---|---|---|---|---|---|
| Blank | 0.0124 | 0.2658 | 91 | 4.46 | 0.0090 | 0.018 |
| Blank* | 0.0051 | 0.2483 | 96 | 2.00 | 0.0026 | 0.005 |
| B (67.5) | 0.0155 | 0.2391 | 88 | 6.09 | 0.0133 | 0.026 |

*sample or procedure error suspected
Treatment B is a nonylphenol-formaldehyde resin alkoxylate polyacrylic acid adduct.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

Having thus described the invention, what we claim is:

1. A method for accelerating the settling of finely divided solids in hydrocarbon fluids comprising adding to said hydrocarbons an effective settling amount of a polyacrylic acid adducted alkylphenolformaldehyde resin alkoxylate compound.

2. The method as claimed in claim 1 wherein said polyacrylic acid adduct is of a nonylphenol-formaldehyde resin propoxyethoxylate.

3. The method as claimed in claim 1 wherein said hydrocarbon is a fluid catalytic cracker slurry.

4. The method as claimed in claim 1 wherein said finely divided solids are fluid catalytic cracker catalyst fines.

5. The method as claimed in claim 1 wherein said hydrocarbon is selected from the group consisting of crude oils and vacuum bottoms.

6. The method as claimed in claim 1 wherein said polvacrylic acid adducted alkylphenol-formaldehyde resin alkoxylate compound is added to said hydrocarbon in a range from about 10 parts per million parts hydrocarbon.

* * * * *